US009340378B2

(12) United States Patent
Ueyama et al.

(10) Patent No.: US 9,340,378 B2
(45) Date of Patent: May 17, 2016

(54) IMAGE FORMING APPARATUS

(71) Applicants: Junki Ueyama, Nagoya (JP); Yoshikazu Shimizu, Nagoya (JP)

(72) Inventors: Junki Ueyama, Nagoya (JP); Yoshikazu Shimizu, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/833,048

(22) Filed: Mar. 15, 2013

(65) Prior Publication Data

US 2013/0256971 A1 Oct. 3, 2013

(30) Foreign Application Priority Data

Mar. 30, 2012 (JP) ..... 2012-080562

(51) Int. Cl.
*B65H 3/06* (2006.01)
*G03G 21/16* (2006.01)
*B65H 5/06* (2006.01)

(52) U.S. Cl.
CPC ..... *B65H 3/0669* (2013.01); *B65H 5/06* (2013.01); *G03G 21/1695* (2013.01); *B65H 2402/441* (2013.01); *B65H 2402/521* (2013.01); *B65H 2404/17* (2013.01); *B65H 2601/324* (2013.01)

(58) Field of Classification Search
CPC .. B65H 3/0615; B65H 3/0669; B65H 3/0676; B65H 2301/4234; B65H 2402/441; B65H 2402/521; B65H 2402/522; B65H 2402/5221; B65H 2402/52211; B65H 2404/17; B65H 2601/324; G03G 21/1633; G03G 21/1695
USPC ..... 271/10.11, 113, 117, 118, 126, 127
See application file for complete search history.

(56) References Cited

U.S. PATENT DOCUMENTS 5,421,569 A * 6/1995 Davidson ..... 271/109
6,300,970 B1 * 10/2001 Hamada et al. ..... 347/264
(Continued)

FOREIGN PATENT DOCUMENTS

JP H07-228367 A 8/1995
JP 03021038 U 2/1996
(Continued)

OTHER PUBLICATIONS

Feb. 17, 2015—(CN) First Office Action and Search Report—App 201310091216.9.
(Continued)

*Primary Examiner* — Ernesto Suarez
(74) *Attorney, Agent, or Firm* — Banner & Witcoff, Ltd.

(57) ABSTRACT

An image forming apparatus includes a main body, a recording sheet receiving portion configured to receive a recording sheet, an image forming portion configured to form an image on the recording sheet, a particular feed roller configured to feed the recording sheet toward the image forming portion, and a holding frame configured to rotatably support the particular feed roller such that the particular feed roller is exposed toward the recording sheet receiving portion. The holding frame has a roller receiving portion configured to receive the particular feed roller therein and a replacement opening for exposing the particular feed roller toward an opposite side of the holding frame relative to the recording sheet receiving portion. The particular feed roller is configured to be attached to and removed from the holding frame via the replacement opening on the opposite side of the holding frame relative to the recording sheet receiving portion.

8 Claims, 11 Drawing Sheets

(56) References Cited

U.S. PATENT DOCUMENTS

| | | | | |
|---|---|---|---|---|
| 6,588,740 | B2 * | 7/2003 | Brugger | B65H 3/06 271/10.01 |
| 6,616,136 | B1 * | 9/2003 | Huang et al. | 271/10.13 |
| 7,275,741 | B2 * | 10/2007 | Worley et al. | 271/117 |
| 7,516,954 | B2 | 4/2009 | Hattori | |
| 8,006,973 | B2 | 8/2011 | Toba et al. | |
| 8,109,500 | B2 * | 2/2012 | Shin et al. | 271/117 |
| 8,371,572 | B2 * | 2/2013 | Blair et al. | 271/117 |
| 8,500,115 | B2 * | 8/2013 | Yamomoto et al. | 271/121 |
| 8,918,012 | B2 * | 12/2014 | Miwa | 399/110 |
| 8,925,913 | B2 * | 1/2015 | Kubo et al. | 271/117 |
| 2006/0180987 | A1 | 8/2006 | Hattori | |
| 2009/0072469 | A1 | 3/2009 | Toba et al. | |

FOREIGN PATENT DOCUMENTS

| | | | | |
|---|---|---|---|---|
| JP | 11227963 | A | | 8/1999 |
| JP | 11334904 | A | * | 12/1999 |
| JP | 2000229736 | A | * | 8/2000 |
| JP | 2000229737 | A | | 8/2000 |
| JP | 2000327147 | A | | 11/2000 |
| JP | 2006096479 | A | | 4/2006 |
| JP | 2009067558 | A | | 4/2009 |
| JP | 2011-131951 | A | | 7/2011 |

OTHER PUBLICATIONS

Oct. 23, 2015—(CN)—Second Office Action—App 201310091216.9.

Nov. 24, 2015—(JP) Notice of Reasons for Rejection—App 2012-080562, Eng Tran.

Feb. 9, 2016—(JP) Decision of Final Rejection—App 2012-080562, Eng Tran.

* cited by examiner

IMAGE FORMING APPARATUS

CROSS REFERENCE TO RELATED APPLICATION

This application claims priority from Japanese Patent Application No. 2012-080562, filed on Mar. 30, 2012, which is incorporated herein by reference in its entirety.

FIELD

Aspects of the disclosure relate to an image forming apparatus including a feed roller configured to feed a recording sheet received on a recording sheet receiving portion toward an image forming portion.

BACKGROUND

A known image forming apparatus includes a recording sheet receiving plate, a feed roller, and an image forming portion. In this image forming apparatus, the feed roller is disposed in a main body such that the feed roller is exposed to the recording sheet receiving plate. The feed roller is configured to feed a recording sheet received on the recording sheet holding plate toward the image forming portion by rotating in contact with the recording sheet.

The feed roller may be worn as it repeatedly feeds recording sheets, resulting in reduction of an accuracy to feed a recording sheet. For replacement, however, it is hard to remove the feed roller toward the recording sheet receiving plate because a space between the feed roller and the recording sheet receiving plate is small.

SUMMARY

Illustrative aspects of the disclosure provide an image forming apparatus facilitating replacement of a feed roller.

According to an aspect of the disclosure, an image forming apparatus includes a main body, a recording sheet receiving portion configured to receive a recording sheet, an image forming portion configured to form an image on the recording sheet, a particular feed roller configured to feed the recording sheet toward the image forming portion, and a holding frame configured to rotatably support the particular feed roller such that the particular feed roller is exposed toward the recording sheet receiving portion. The holding frame has a roller receiving portion configured to receive the particular feed roller therein and a replacement opening for exposing the particular feed roller toward an opposite side of the holding frame relative to the recording sheet receiving portion. The particular feed roller is configured to be attached to and removed from the holding frame via the replacement opening on the opposite side of the holding frame relative to the recording sheet receiving portion.

BRIEF DESCRIPTION OF THE DRAWINGS

Illustrative aspects will be described in detail with reference to the following figures in which like elements are labeled with like numbers and in which:

FIGS. 7A and 7B illustrate mounting of the feed roller unit, wherein FIG. 7A illustrates that the feed roller unit is brought close to the holding frame from above and FIG. 7B illustrates that the feed roller unit is received in the roller receiving portion;

FIGS. 8A and 8B illustrate mounting of the feed roller unit, wherein FIG. 8A illustrates that the roller shaft engages in an engaging portion of a separation roller and FIG. 8B illustrates that a bearing member is disposed outside of the roller receiving portion of the holding frame;

FIGS. 9A and 9B illustrate mounting of the feed roller unit, wherein FIG. 9A illustrates that the bearing member is fitted around the separation roller and FIG. 9B illustrates that the bearing member is engaged in the holding frame;

DETAILED DESCRIPTION

A first illustrative embodiment will be described in detail with reference to the accompanying drawings. In the following description, a general structure of a laser printer as an example of an image forming apparatus will be described and then features of the disclosure will be described in detail.

In the following description, directions are referred based on the laser printer disposed in an orientation in which it is intended to be used. In other words, in FIG. 1, the left side is referred to as the front or front side, the right side is referred to as the rear or the rear side, the up side is referred to as the top or upper side, and the down side is referred to as the bottom or lower side.

Figure 1:
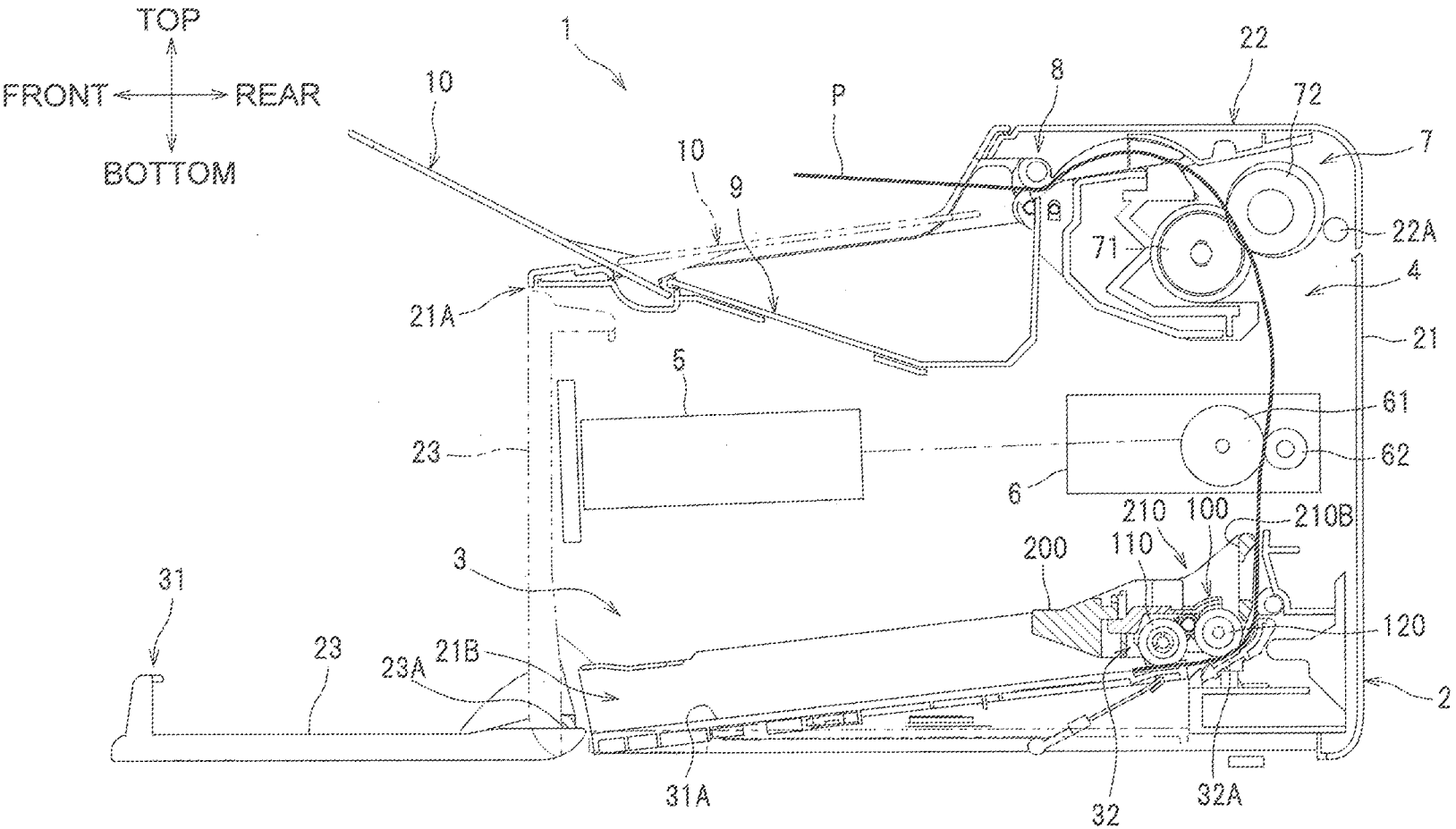
FIG. 1 illustrates a general structure of an illustrative image forming apparatus, e.g. a laser printer, according to an embodiment.

As shown in FIG. 1, the laser printer 1 includes a main body 2, a feeder portion 3 for feeding a sheet P as an example of a recording sheet, and an image forming portion 4 for forming an image on the sheet P.

The main body 2 includes a casing 21, a top cover 22, and a front cover 23. The casing 21 has an opening 21A, in an upper portion thereof, through which a process cartridge is attached and removed, and an insertion opening 21B, in a front portion thereof, for inserting sheets P.

The opening 21A in the upper portion of the casing 21 is opened and closed by the top cover 22, and the insertion opening 21B in the front portion of the casing 21 is opened and closed by the front cover 23.

Specifically, the top cover 22 is configured to pivot upward about a pivot 22A of the top cover 22 disposed in an upper rear portion of the main body 2. The top cover 22 covers from a rear end portion of the main body 2 to a front end portion thereof, and pivots upward such that an upper side of the main body 2 is released.

The front cover 23 is configured to pivot frontward about a pivot 23A of the front cover 23 disposed in a lower front portion of the main body 2. The front cover 23 covers from a lower end portion of the main body 2 to an upper end portion thereof, and pivots frontward such that a front side of the main body 2 is released. In FIG. 1, the front cover 23 closing the front side of the main body 2 is indicated by a double dotted line, and the front cover 23 releasing the front side of the main body 2 is indicated by a solid line.

The feeder portion 3 is disposed in a lower portion of the main body 2, and includes a sheet tray 31 for receiving a sheet P thereon and a sheet feed mechanism 32 that feeds the sheet P on the sheet tray 31 toward the image forming portion 4.

The sheet tray 31 includes the front cover 23 and a receiving plate 31A, as an example of a recording sheet receiving portion, which is disposed in a lower portion of the main body 2. Specifically, the front cover 23 constitutes a part of the sheet tray 31 when tilted frontward. In other words, when a sheet P is inserted with the front cover 23 being tilted frontward, a trailing side of the sheet P is received on the receiving plate 31A and a leading side of the sheet P is received on the front cover 23. The receiving plate 31A is configured to pivot about a pivot shaft, which is not shown and disposed at the front end of the main body 2, such that the rear end of the receiving plate 31A vertically moves toward or away from a feed roller, e.g., a pickup roller 110, and to raise a sheet P received on the receiving plate 31A toward the pickup roller 110.

The sheet feed mechanism 32 includes the pickup roller 110, a separation roller 120, and a separation pad 32A. The pickup roller 110 is disposed upstream of the separation roller 120 in a sheet feeding direction, and above the rear end of the receiving plate 31A. The separation roller 120 is disposed facing the separation pad 32A.

In the feeder portion 3, the front cover 23 is tilted down frontward to form the sheet tray 31, and a sheet P is received on the sheet tray 31. When the rear end of the receiving plate 31A moves upward, the pickup roller 110 contacts the sheet P received on the sheet tray 31. When the pickup roller 110 rotates in this state, the sheet P received on the sheet tray 31 is conveyed to the separation roller 120, the sheet P is singly separated by the separation roller 120 and the separation pad 32A and then conveyed to the image forming portion 4.

The image forming portion 4 includes a scanner unit 5, a process cartridge 6 as an example of a detachable member, and a fixing unit 7.

The scanner unit 5 is disposed in a central portion at the front side of the main body 2, and includes a laser emitting portion, a polygon mirror, a lens, and a reflecting mirror, which are not shown. The scanner unit 5 irradiates a surface of a photosensitive drum 61 with a laser beam at high speed scanning.

Figure 2:
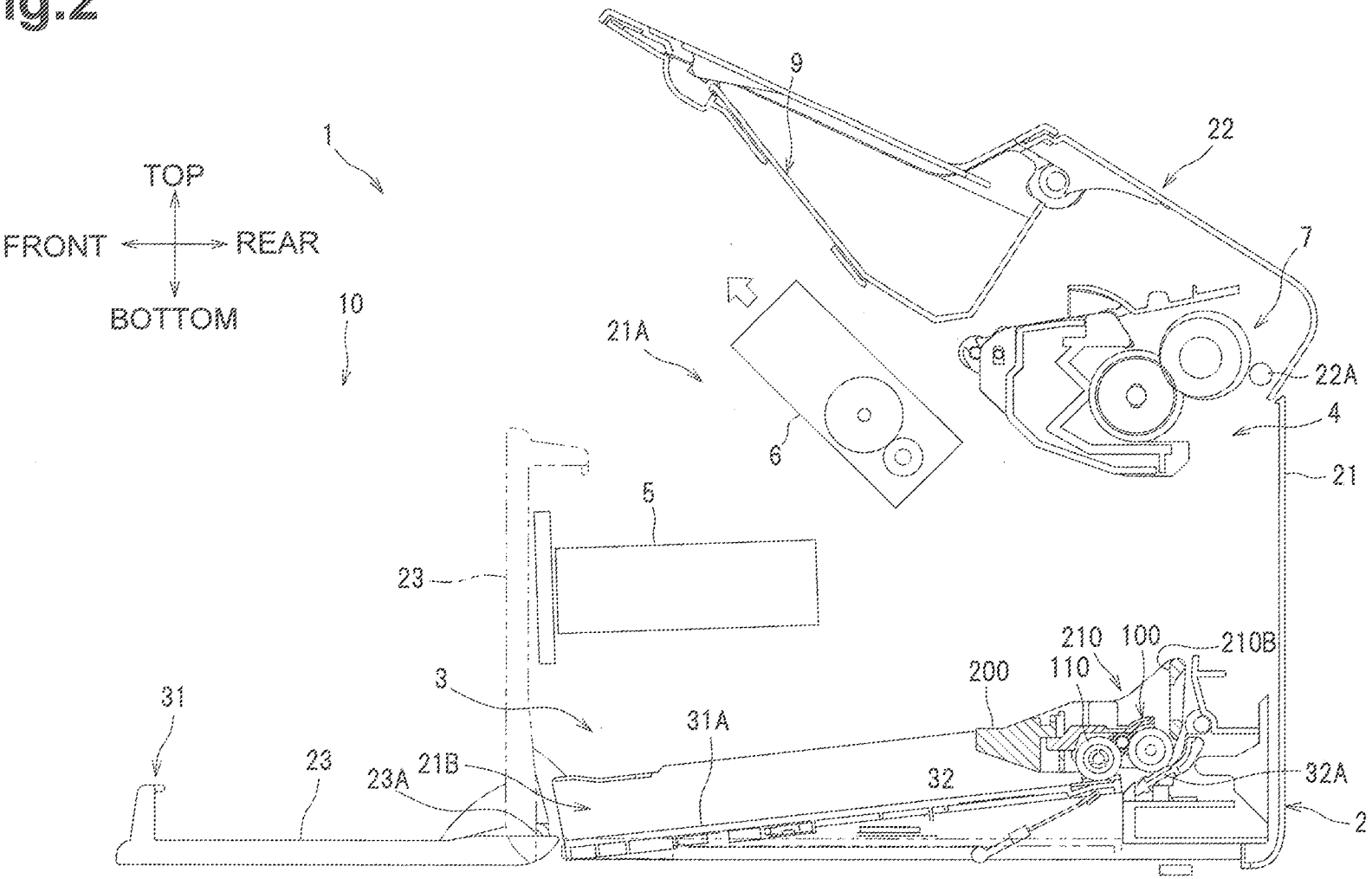
FIG. 2 illustrates that a top cover of the laser printer is open and a process cartridge is being removed from a main body.

The process cartridge 6 is located in a central portion at the rear side of the main body 2, and disposed above the sheet feed mechanism 32. The process cartridge 6 is detachable through the opening 21A from the casing 21 upward and frontward (FIG. 2). The process cartridge 6 is an example of a photosensitive member holding member including a photosensitive drum 61. The process cartridge 6 further includes a transfer roller 62 that transfers a toner image or developer image formed on the photosensitive drum 61 to a sheet P, a charger, a developing roller, a layer thickness regulating blade, and a toner chamber, which are known and not shown.

In the process cartridge 6, the surface of the photosensitive drum 61, which is rotating, is uniformly charged by the charger, and then exposed with the laser beam from the scanner unit 5 by high speed scanning. Thus, a potential in an exposed area drops, and an electrostatic latent image based on image data is formed on the surface of the photosensitive drum 61.

The developing roller supplies toner in the toner chamber to the electrostatic latent image formed on the photosensitive drum 61, and a toner image is formed on the surface of the photosensitive drum 61. Then, when a sheet P passes between the photosensitive drum 61 and the transfer roller 62, the toner image carried on the surface of the photosensitive drum 61 is transferred onto the sheet P.

The fixing unit 7 is disposed in an upper rear side of the main body 2. The fixing unit 7 is located above the process cartridge 6 and includes a heat roller 71 and a pressure roller 72.

The heat roller 71 is a member that applies heat to a sheet P, and includes a heat source, e.g., a halogen lamp, which is not shown, inside.

The pressure roller 72 is a member that feeds a sheet P by sandwiching the sheet P with the heat roller 71, and is disposed diagonally upward from the rear side of the heat roller 71.

In the fixing unit 7, toner transferred onto the sheet P is fixed thermally while the sheet P passes between the heat roller 71 and the pressure roller 72. The sheet P having the toner fixed thermally is conveyed to an ejection roller 8, which is disposed downstream of the fixing unit 7, and ejected from the ejection roller 8 to an ejection tray 9.

The ejection tray 9 extends diagonally upward from the rear side of the main body 2 to the front side thereof, and is provided as a part of the top cover 22. An extension tray 10 is disposed frontward of the top cover 22 and at a front end of the ejection tray 9. The extension tray 10 has a pivot axis in the vicinity of the front end portion of the ejection tray 9, and is configured to pivot between a position facing the extension tray 9, which is indicated by a chain double-dashed line, and a position indicated by a solid line. When no image is formed, the extension tray 10 is folded to the position indicated by the chain double-dashed line to cover the ejection tray 9. When an image is formed, the extension tray 10 is unfolded to the position indicated by the solid line to hold a leading end of a sheet P to be ejected.

In this laser printer 1, the sheet feed mechanism 32 is disposed in the vicinity of the rear end portion of the sheet tray 31. The image forming portion 4 is disposed above the sheet feed mechanism 32, and the ejection roller 8 and the ejection tray 9 are disposed frontward of the fixing unit 7 of the image forming portion 4. With these dispositions, the laser printer 1 is structured such that a sheet P conveyed from the sheet tray 31 is conveyed in the shape of a letter U in the main body 2 and then ejected outside the main body 2.

The following will describe structures of the pickup roller 110 and the separation roller 120.

Figure 3A:
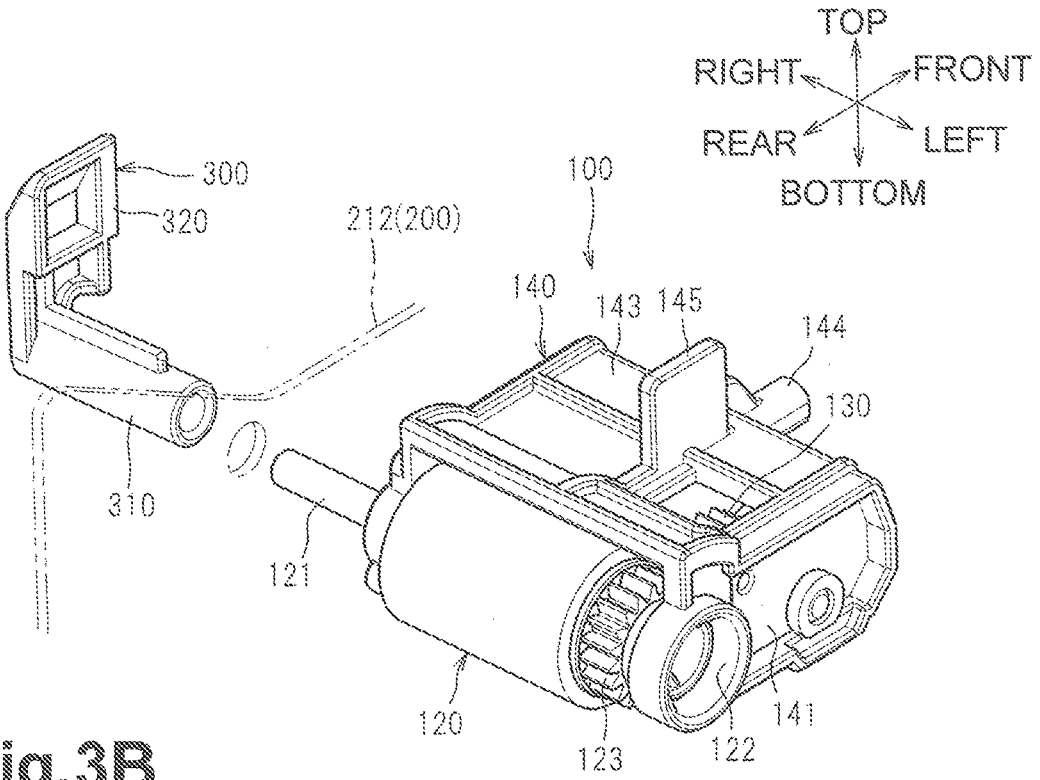
FIG. 3A is a perspective view illustrating a feed roller unit and a bearing member.
Figure 3B:
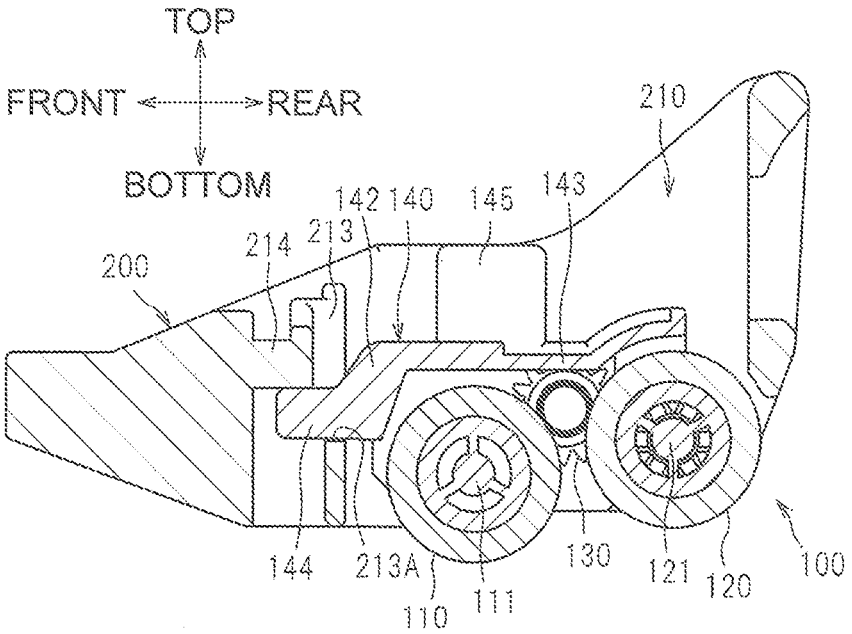
FIG. 3B is a side sectional view illustrating the feed roller unit supported by a holding frame.

As shown in FIGS. 3A and 3B, the pickup roller 110 and the separation roller 120 are combined into one part as a feed roller unit 100. The feed roller unit 100 includes the pickup roller 110, the separation roller 120, an idle gear 130, and a connecting member 140. The feed roller unit 100 is supported by a holding frame 200 such that the pickup roller 110 and the separation roller 120 are rotatable.

The pickup roller 110 is rotatably supported by the connecting member 140. A pickup roller gear, which is not shown, is fixed at a left end portion of a shaft 111 of the pickup roller 110.

The separation roller 120 is rotatably supported by the connecting member 140 at a position spaced rearward from the pickup roller 110. A left end portion of a shaft 121 of the separation roller 120 is provided with an engaging portion 122 in which a roller shaft 400 is engaged, and a separation roller gear 123. The engaging portion 122 is disposed at the left end of the shaft 121 of the separation roller 120 and is open to the left side. An inner peripheral surface of the engaging portion 122 has protrusions and grooves formed thereon, which match those formed on a peripheral surface of a right end portion 410 of the roller shaft 400. A right end portion of the shaft 121 of the separation roller 120, opposite to the roller shaft 400, extends outside beyond the connecting member 140, and is rotatably supported by a bearing member 300 as an example of a bearing.

The bearing member 300 is detachable from the shaft 121 of the separation roller 120 and includes a bearing portion 310 and an operation portion 320. The bearing portion 310 has a cylindrical shape which is long in the left-right direction, and is configured to receive the shaft 121 of the separation roller 120 inside. The operation portion 320 is integral with the bearing portion 310 and is a plate-like member extending radially outside from a right end of the bearing portion 310.

The idle gear 130 is rotatably supported by the connecting member 140 between the pickup roller 110 and the separation roller 120 in the front-rear direction. The idle gear 130 engages the pickup roller gear and the separation roller gear 123. Thus, when the separation roller 120 rotates, the pickup roller 110 is configured to rotate.

The connecting member 140 integrally holds the pickup roller 110 and the separation roller 120. The connecting member 140 includes a pair of left and right sidewalls 141, a front wall 142, and an upper wall 143.

The sidewalls 141 are long in the front-rear direction, and support the pickup roller 110, the separation roller 120, and the idle gear 130 rotatably.

The front wall 142 connects front ends of the sidewalls 141, and has a boss 144 protruding frontward in substantially a central portion in the left-right direction.

The upper wall 143 connects upper ends of the sidewalls 141 and has a tab portion 145 extending upward in substantially a central portion in the left-right direction.

The following will describe a structure of the holding frame 200 that detachably supports the feed roller unit 100.

Figure 4:
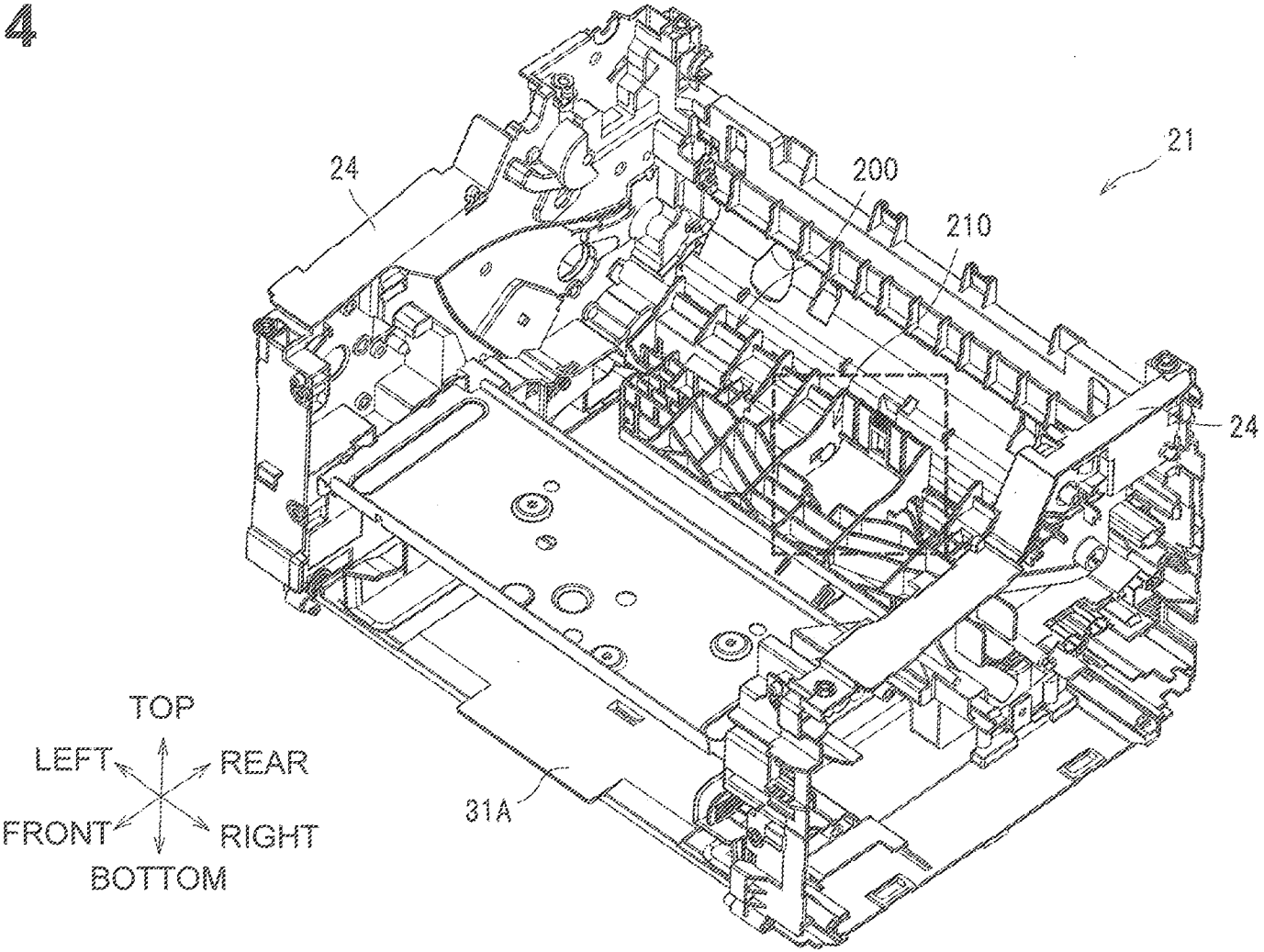
FIG. 4 is a perspective view illustrating a frame constituting the main body and the holding frame.
Figure 5:
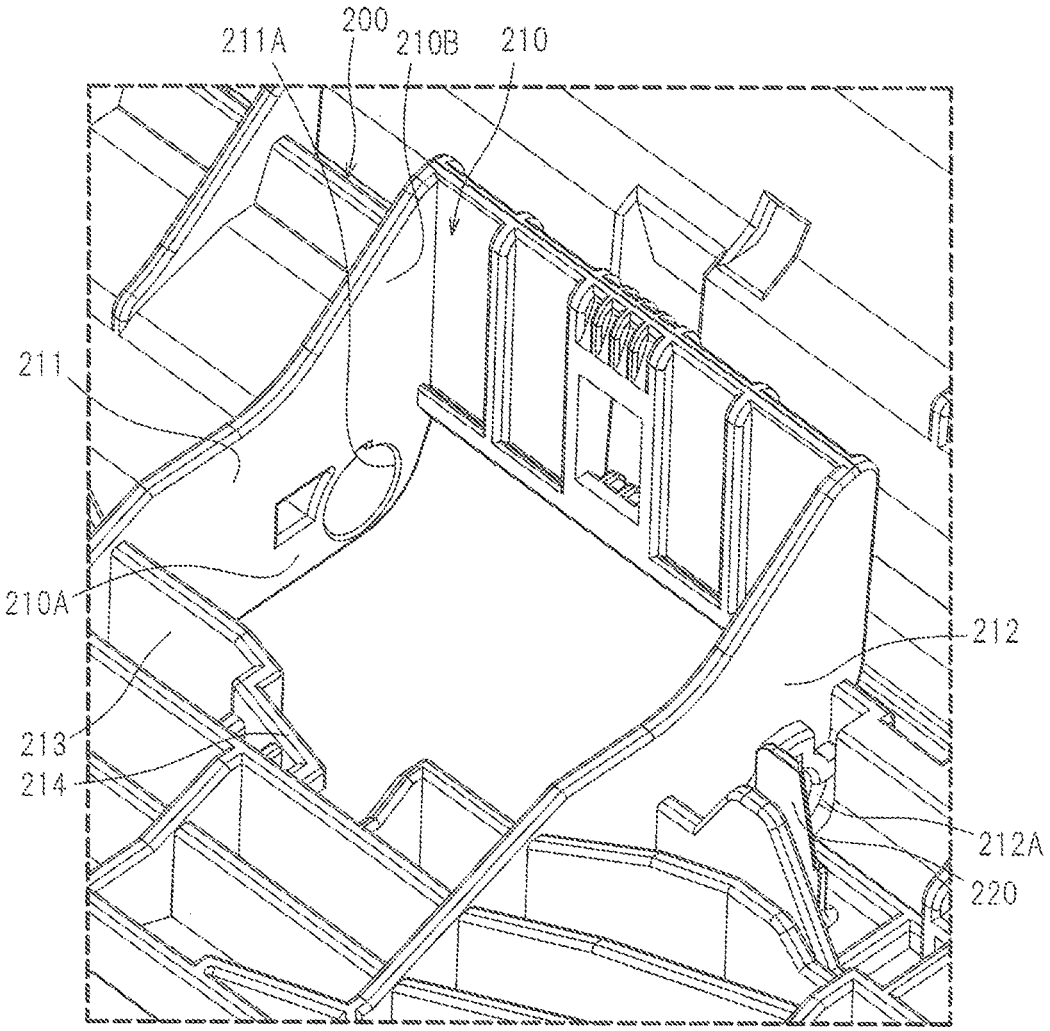
FIG. 5 is an enlarged perspective view of an area enclosed by a broken line in FIG. 4, illustrating the vicinity of the roller receiving portion.

As shown in FIG. 4, the holding frame 200 is disposed above the rear end portion of the receiving plate 31A, and is a member to connect rear end portions of a pair of left and right sidewalls 24 constituting the casing 21. The holding frame 200 has a roller receiving portion 210 in substantially a central portion in the left-right direction. As shown in FIG. 5, the roller receiving portion 210 has a working opening 210A which is open downward and a replacement opening 210B which is open upward.

The roller receiving portion 210 receives the feed roller unit 100. As the working opening 210A and the replacement opening 210B pass through vertically, the upper side (toward the receiving plate 31A) and the lower side (opposite to the receiving plate 31A) of the feed roller unit 100 are exposed from the holding frame 200 (FIG. 3B). The replacement opening 210B is located such that it is visually checked through the opening 21A when the process cartridge 6 is removed from the main body 2 (FIG. 2).

Figure 6:
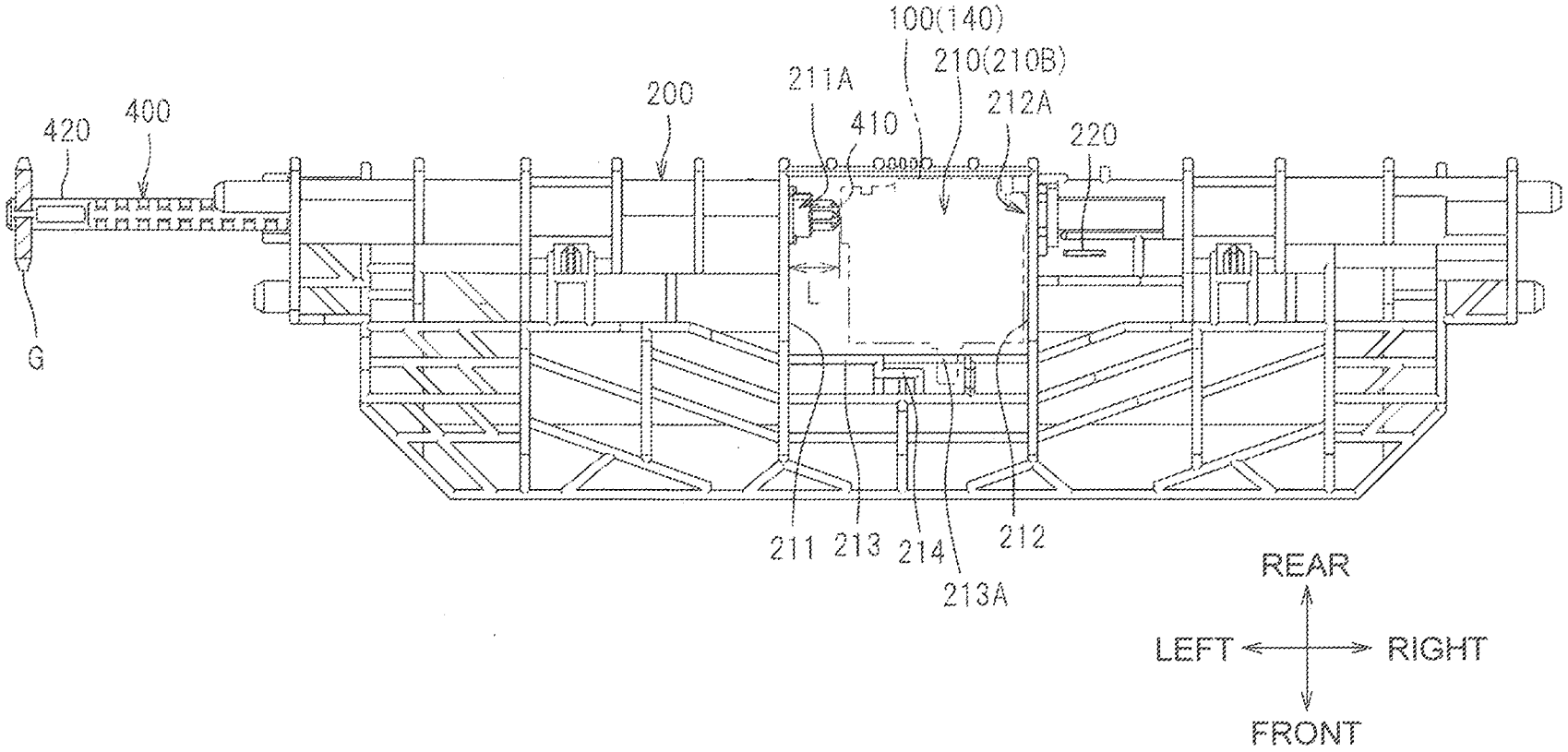
FIG. 6 is a top view illustrating the holding frame and a roller shaft.

As shown in FIG. 6, the roller receiving portion 210 has a dimension, in a width direction of the sheet P or the left-right direction, which is slightly greater than that of the connecting member 140 of the feed roller unit 100 plus a specified distance L. In other words, the roller receiving portion 210 is sized to allow the feed roller unit 100 to move the specified distance L or more in the left-right direction inside the roller receiving portion 210. The specified distance L is a length of the roller shaft 400 which protrudes inside of the roller receiving portion 210. Thus, a portion of the roller shaft 400 protruding inside of the roller receiving portion 210 can be engaged in the engaging portion 122 of the feed roller unit 100 by moving the feed roller unit 100 in the left-right direction in the roller receiving portion 210.

As shown in FIGS. 5 and 6, the roller receiving portion 210 is shaped in a rectangular frame, and includes a left wall 211, a right wall 212, and a front wall 213 that connects front end portions of the left wall 211 and the right wall 212.

The rear end portion of the left wall 211 has a first hole 211A formed therethrough in the left-right direction. The first hole 211A has a size of which the roller shaft 400 can pass through.

The rear end portion of the right wall 212 has a second hole 212A formed therethrough in the left-right direction. The second hole 212A receives the bearing portion 310 of the bearing member 300, and has a diameter smaller than that of the operation portion 320 of the bearing member 300.

As shown in FIG. 3B, the front wall 213 has a recessed portion 213A in substantially a central portion, which is one level lower than both ends of the front wall 213 in the left-right direction. A regulating portion 214 is disposed above the recessed portion 213A such that the boss 144 of the connecting member 140 is sandwiched vertically between the regulating portion 241 and the recessed portion 213A. The recessed portion 213A extends rightward further than the regulating portion 214 (FIG. 6).

As shown in FIGS. 5 and 6, a rib 220 is provided at a position away from the right wall 212 on the right side of the replacement opening 210B of the holding frame 200. The rib 220 extends upward from a lower wall of the holding frame 200. A distance between the rib 220 and the right wall 212 is substantially equal to a thickness (or a size in the left-right direction) of the operation portion 320 of the bearing member 300.

As shown in FIG. 6, the holding frame 200 rotatably supports the roller shaft 400. The roller shaft 400 connects a drive gear G disposed at the left end portion of the holding frame 200 in the left-right direction, and the separation roller 120.

Specifically, the right end portion 410 of the roller shaft 400 protrudes, by the specified distance L, inside the roller receiving portion 210 through the first hole 211A of the left wall 211 of the roller receiving portion 210. The portion of the roller shaft 400 protruding inside the roller receiving portion 210 is engaged in the engaging portion 122. The left end portion 420 of the roller shaft 400 extends outward more than the left end of the holding frame 200, and the drive gear G is fixed at an end portion of the left end portion 420. The drive gear G is configured to receive a driving force from a drive source, which is not shown and provided in the main body 2, and transmit a rotational driving force to the separation roller 120 via the roller shaft 400.

Figure 9A:
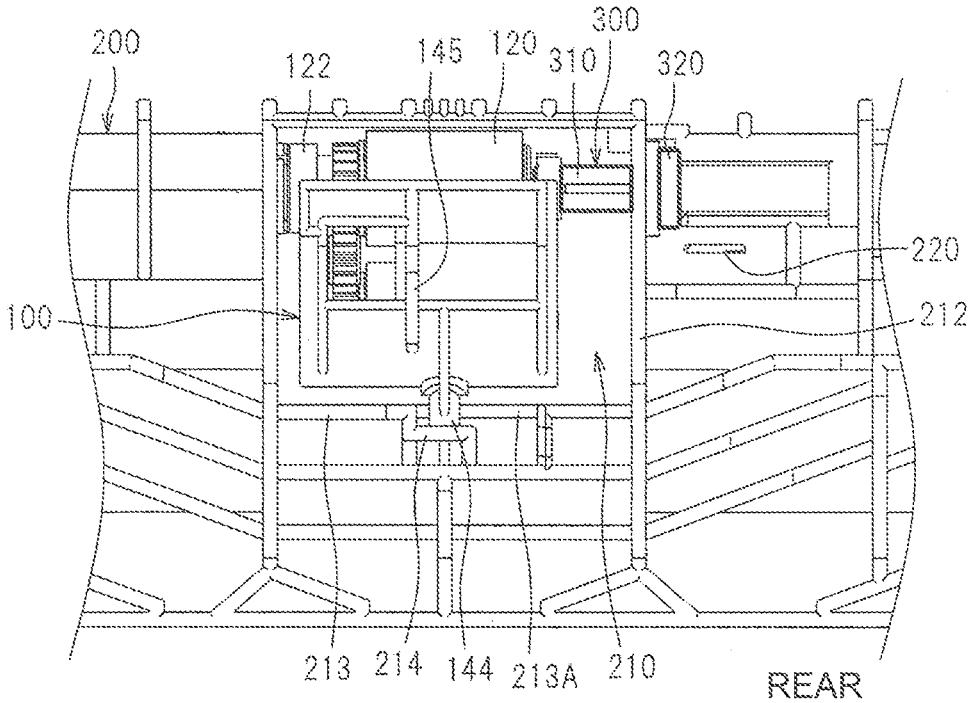
Figure 9B:
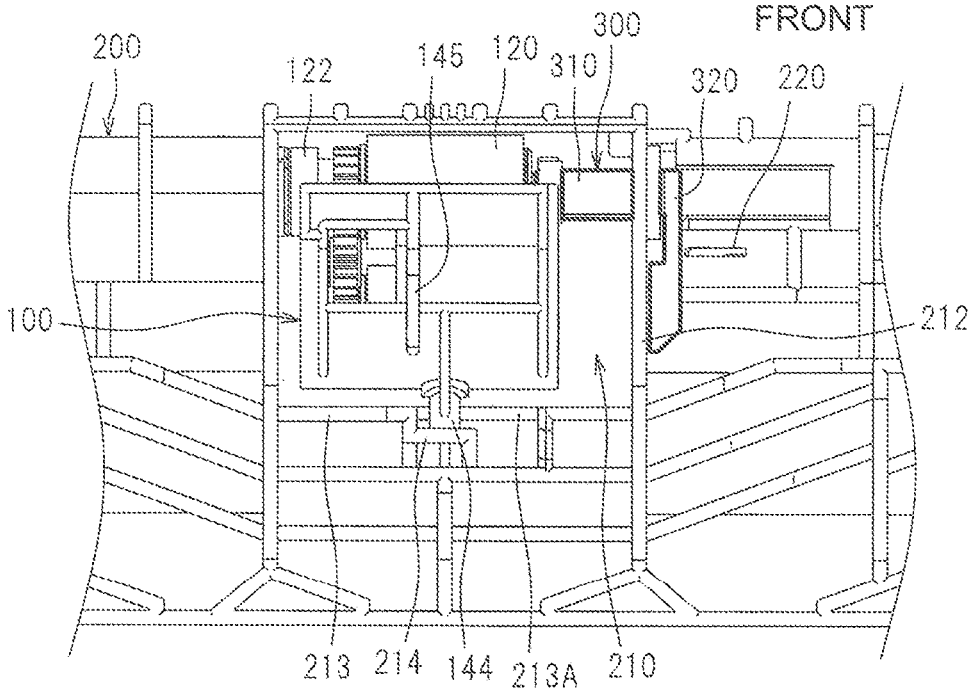

As shown in FIGS. 3B and 9B, the holding frame 200 supports the feed roller unit 100 by supporting the separation roller 120 via the bearing member 300 and the roller shaft 400 and the boss 144 of the connecting member 140 at the recessed portion 213A of the front wall 213. The boss 144 is vertically sandwiched by the recessed portion 213A of the front wall 213 and the regulating portion 214, which prevents the pickup roller 110 from pivoting vertically about the separation roller 120.

The following will describe how the feed roller unit 100 is attached to or removed from the holding frame 200.

To attach or remove the feed roller unit 100, the top cover 22 is opened and the process cartridge 6 is removed from the main body 2. Thus, the replacement opening 210B is exposed.

Figure 7A:
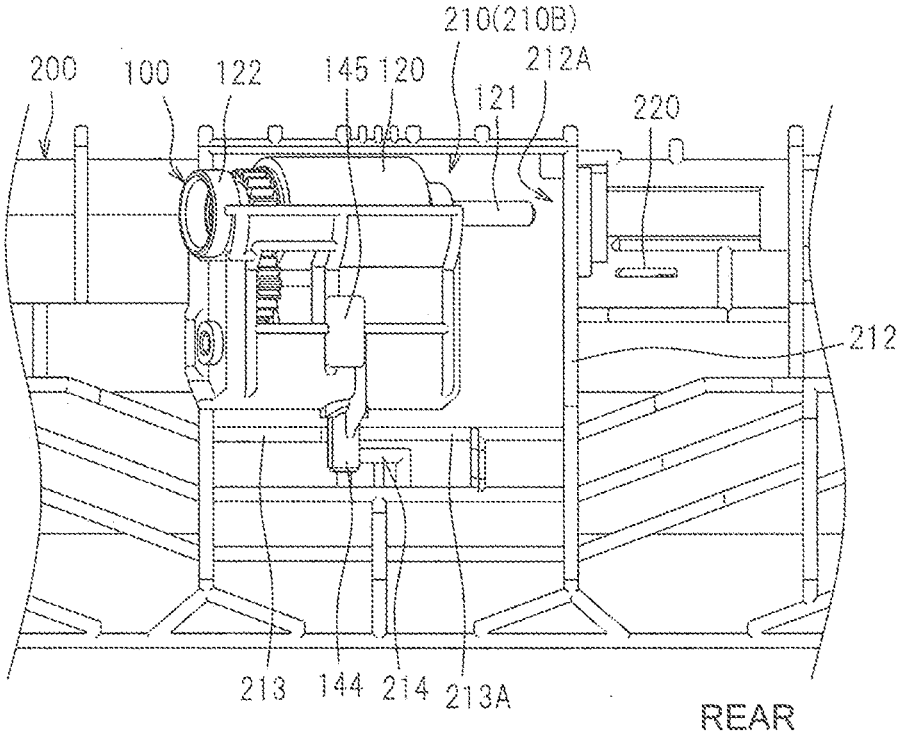
Figure 7B:
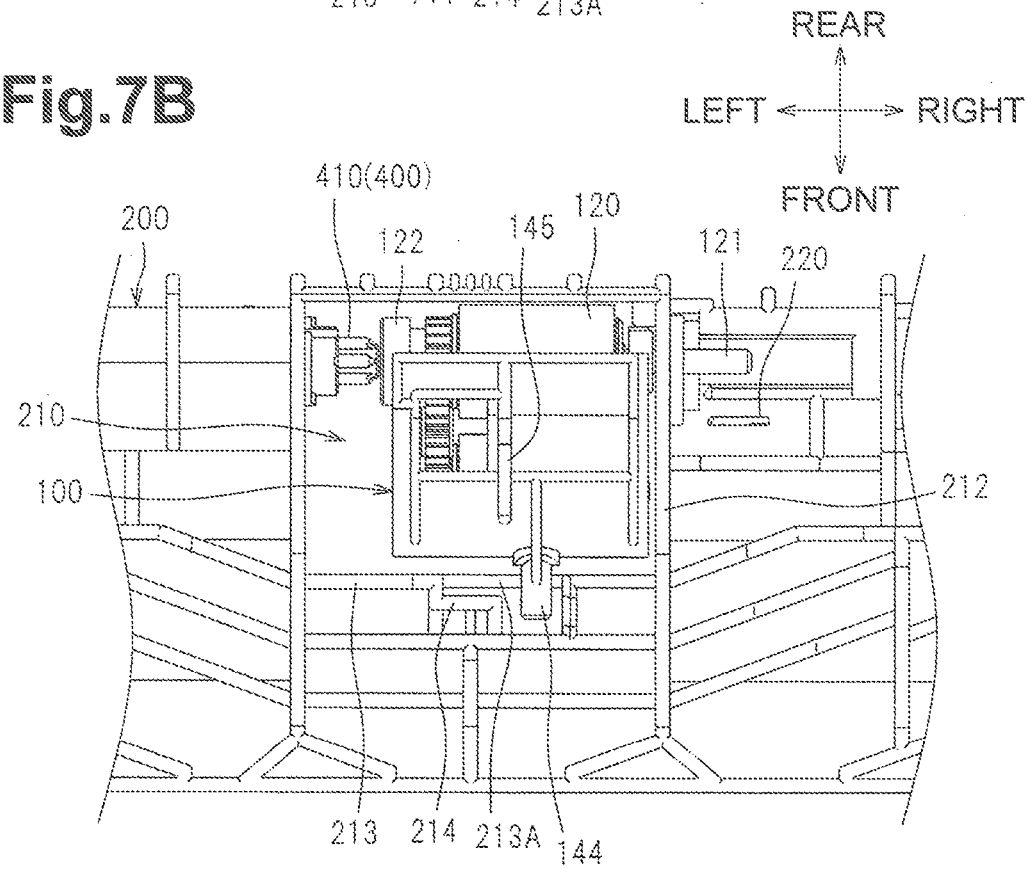

When the feed roller unit 100 is attached to the holding frame 200, as shown in FIG. 7A, the tab portion 145 of the feed roller unit 100 is pinched, and the feed roller unit 100 is moved toward the replacement opening 210B of the holding frame 200 from above. As shown in FIG. 7B, the right end portion of the shaft 121 of the separation roller 120 is inserted into the second hole 212A of the holding frame 200, the feed roller unit 100 is moved to the right wall 212 and accommodated in the roller receiving portion 210. At this time, the boss 144 of the connecting member 140 is placed on the recessed portion 213A of the front wall 213 of the holding frame 200.

Figure 8A:
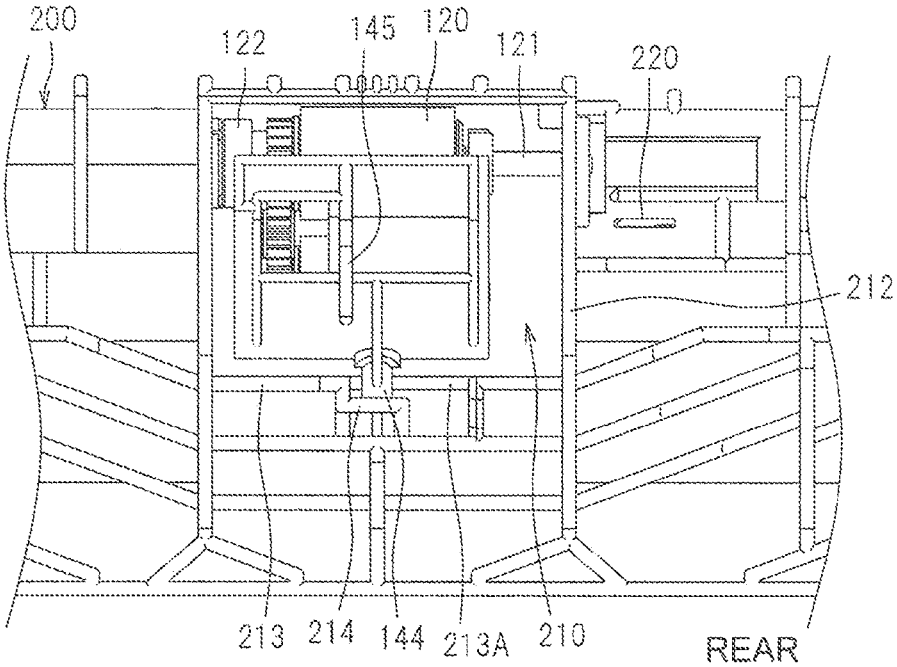

As shown in FIG. 8A, while the tab portion 145 is pinched, the feed roller unit 100 is slid leftward such that the right end portion 410 of the roller shaft 400 is engaged in the engaging portion 122 of the separation roller 120. At this time, the boss 144 of the connecting member 140 slides in between the recessed portion 213A of the front wall 213 and the regulating portion 214 of the holding frame 200.

Figure 8B:
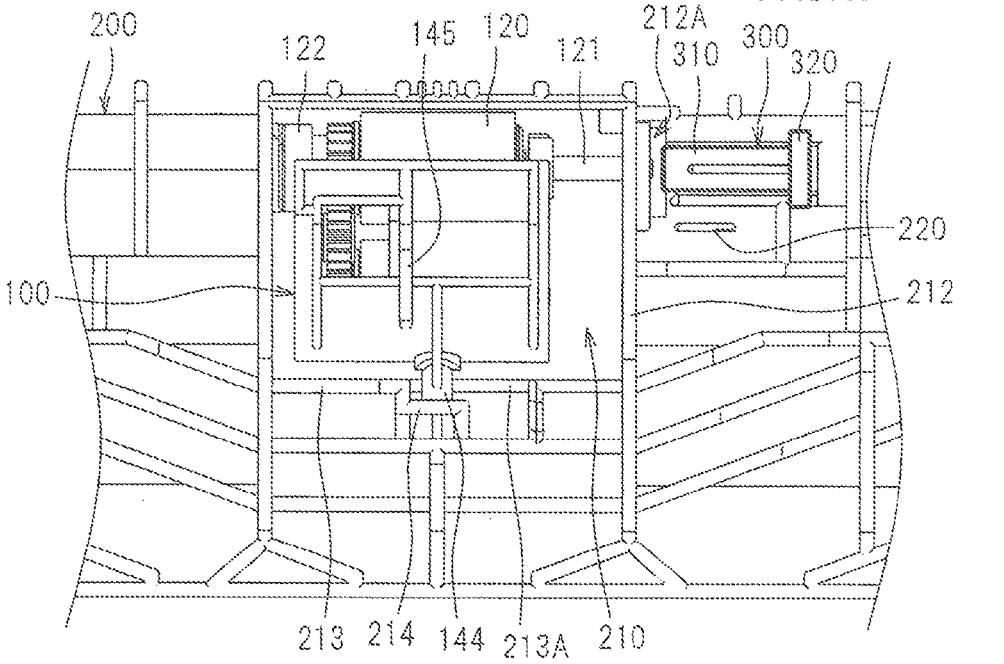

As shown in FIG. 8B, the operation portion 320 is pinched and the bearing member 300 is positioned outside of the right side of the roller receiving portion 210. Specifically, the bearing member 300 is positioned such that an end of the bearing member 300 faces toward the second hole 212A of the roller receiving portion 210.

Then, as shown in FIG. 9A, the bearing member 300 is slid leftward such that the bearing portion 310 is fitted around the shaft 121 of the separation roller 120. As shown in FIG. 9B, the operation portion 320 is turned frontward by 90 degrees such that the operation portion 320 is fitted in between the rib 220 of the holding frame 200 and the right wall 212.

When the feed roller unit 100 is removed from the holding frame 200, the above procedures are reversed. Specifically, the bearing member 300 is turned upward by 90 degrees and is slid such that the bearing member 300 is removed from the holding frame 200. Then, the feed roller unit 100 is slid rightward to disconnect the engaging portion 122 from the right end portion 410 of the roller shaft 400. Then, the feed roller unit 100 is raised and removed from the holding frame 200.

According to the embodiment, the following effects can be obtained.

The feed roller unit 100 is detachable to the holding frame 200 via the replacement opening 210B of the holding frame 200 from the upper side of the holding frame 200. Thus, the feed roller unit 100, which is disposed in the vicinity of the rear end portion of the sheet tray 31 or at the rear side of the main body 2, can be easily replaced through the replacement opening 210B, as compared with a conventional structure where the feed roller unit 100 is replaced from the lower side of the feed roller unit 100.

The roller receiving portion 210 of the holding frame 200 is sized to allow the feed roller unit 100 to move the specified distance L or more in the left-right direction inside the roller receiving portion 210. Thus, even when the roller shaft 400 protrudes by the specified distance L inside the roller receiving portion 210, the feed roller unit 100 can be attached or removed by sliding the feed roller unit 100 in the left-right direction.

The bearing member 300 is disposed such that the operation portion 320 is fitted in between the rib 220 of the holding frame 200 and the right wall 212. As the operation portion 320 engages against the rib 220 or the right wall 212, movement of the bearing member 300 in the left-right direction is limited. Thus, the feed roller unit 100 can be prevented from coming off from the holding frame 200.

The replacement opening 210B of the holding frame 200 is exposed by removing the process cartridge 6 from the main body 2. This facilitates attaching or removing of the feed roller unit 100 because the feed roller unit 100 can be attached or removed while it is visually checked.

The process cartridge 6 is generally structured for facilitating replacement as it is to be regularly replaced. Thus, it become easier to replace the feed roller unit 100 compared with a case where a component, which is difficult to be removed, is removed from the main body 2 to expose the replacement opening 210B of the holding frame 200.

The above embodiment shows, but is not limited to, a monochrome laser printer 1 with one process cartridge 6 including the photosensitive drum 61 as an example of the image forming apparatus of the disclosure. For example, the image forming apparatus may include color laser printers, multifunction machines, and copiers, which all have a plurality of process cartridges 6.

The above embodiment shows, but is not limited to, the process cartridge 6 as an example of a detachable member which is detachable from the main body 2. For example, in the case of a color laser printer, the detachable member may include a holder for holding a plurality of photosensitive drums 61 and a belt disposed facing the photosensitive drums 61.

Figure 10:
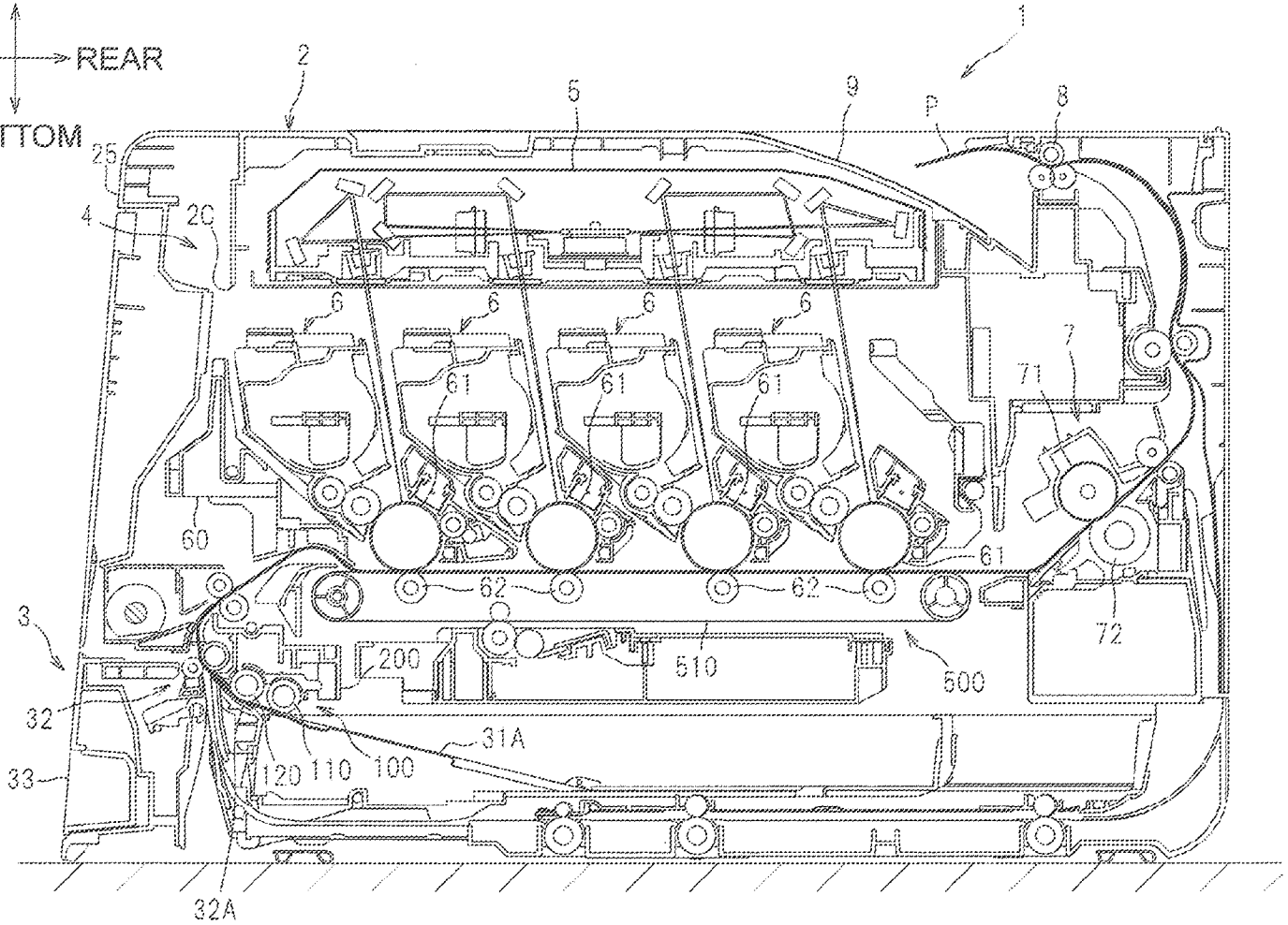
FIG. 10 illustrates a general structure of a color printer according to a modification.

Specifically, a case where the image forming apparatus is a color laser printer 1 will be described with reference to FIG. 10. In the laser printer 1, the image forming portion 4 is disposed above the feeder portion 3, and includes four process cartridges 6, a holder 60 for integrally holding the four process cartridges 6, and a transfer unit 500.

The transfer unit 500 includes a belt 510 and a plurality of transfer rollers 62. The belt 510 is disposed opposite to each of the process cartridges 6. The transfer rollers 62 are disposed opposite to the photosensitive drums 61 such that the belt 510 is sandwiched between the transfer rollers 62 and the photosensitive drums 61.

The holder 60 and the transfer unit 500 are detachable from the main body 2 through an opening 2C formed by releasing the front cover 25 disposed at the front surface of the main body 2.

Figure 11:
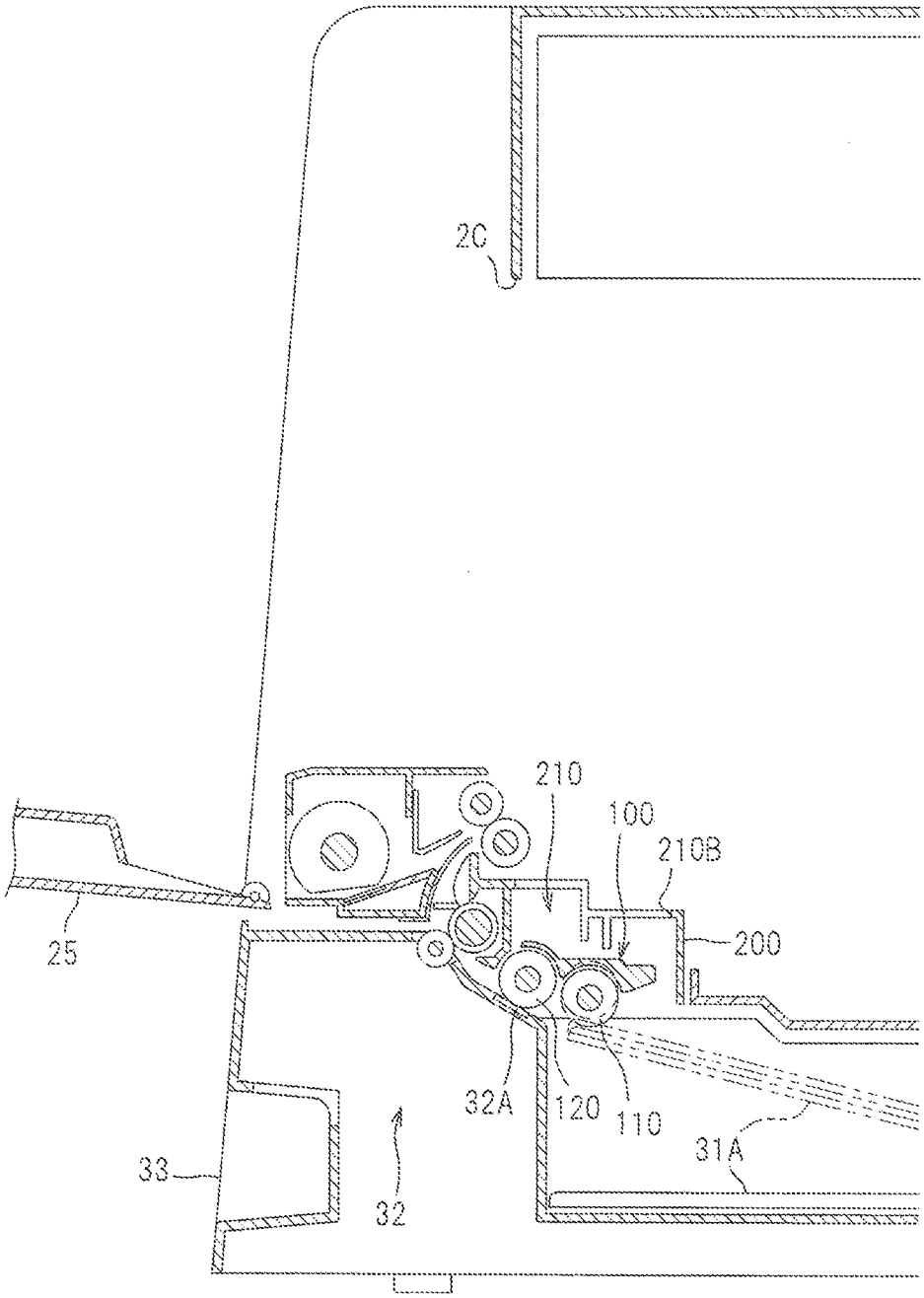
FIG. 11 is an enlarged view of the vicinity of a feed roller unit in the color printer according to the modification, illustrating that a holder and a belt unit is removed from the main body with a front cover being open.

As shown in FIG. 11, when the holder 60 and the transfer unit 500 are removed from the main body 2, an upper portion of the holding frame 200 is released and the replacement opening 210B is exposed. Thus, the feed roller unit 100 can be replaced while the roller receiving portion 210 where the feed roller unit 100 is attached is visibly checked.

The above embodiment shows, but is not limited to, that the pickup roller 110 is configured not to pivot relative to the separation roller 120. The pickup roller 110 may be configured to pivot about the separation roller 120.

Specifically, as shown in FIG. 11, the pickup roller 110 is configured to pivot about the separation roller 120, and is urged downward by an urging member which is not shown. With this structure, the receiving plate 31A is moved to the pickup roller 110 until a sheet P received on the receiving plate 31A contacts the pickup roller 110, and then the receiving plate 31A is further raised, thereby an appropriate pressure is applied between the pickup roller 110 and the receiving plate 31A. Thus, the sheet P can be conveyed reliably.

The above embodiment shows, but is not limited to, that the pickup roller 110 and the separation roller 120 are used as feed rollers. One feed roller may be used.

The above embodiment shows, but is not limited to, that the sheet P conveyed from the receiving plate 31A is turned once in the shape of a letter U in the main body 2 and then ejected outside the main body 2. The sheet P may be turned twice or more in the shape of the letter U. For example, as shown in FIG. 10, the feeder portion 3, the image forming portion 4, and the ejection tray 9 may be disposed such that the sheet P conveyed from the receiving plate 31A may be turned once in the shape of the letter U between the feeder portion 3 and the image forming portion 4 and then turned again in the shape of the letter U until the sheet P is ejected from the image forming portion 4 outside the main body 2.

The above embodiment shows, but is not limited to, the photosensitive drum 6 as a photosensitive member. The photosensitive member may include a belt-type photosensitive member.

The sheet P, as an example of a recording sheet, may include a thick paper, a postcard, a thin paper, and a transparency.

While the features herein have been described in connection with various example structures and illustrative aspects, it will be understood by those skilled in the art that other variations and modifications of the structures and aspects described above may be made without departing from the scope of the inventions described herein. Other structures and aspects will be apparent to those skilled in the art from a consideration of the specification or practice of the features disclosed herein. It is intended that the specification and the described examples only are illustrative with the true scope of the inventions being defined by the following claims.

What is claimed is:

1. An image forming apparatus comprising:

a main body including a top cover configured to open and close an upper opening;

a recording sheet receiving portion configured to receive a recording sheet and disposed in a lower portion of the main body;

an image forming portion disposed in the main body and configured to form an image on the recording sheet, the image forming portion including a process cartridge configured to be attached to and removed from the main body through the upper opening opened by the top cover;

a feed roller unit including a pickup roller, a separation roller, and a connecting member, the connecting member holding the pickup roller and the separation roller such that the pickup roller is disposed upstream of the separation roller in a sheet feeding direction, the pickup roller being configured to rotate in contact with the recording sheet received on the recording sheet receiving portion, the separation roller being configured to rotate in contact with the recording sheet fed by the pickup roller to feed the recording sheet toward the image forming portion, the connecting member having an upper wall, the upper wall completely covering an upper portion of the pickup roller;

a holding frame disposed between the recording sheet receiving portion and the image forming portion and configured to support the feed roller unit such that the pickup roller and the separation roller are exposed toward the recording sheet receiving portion;

a drive gear disposed in one end portion of the holding frame in a width direction of the recording sheet and configured to transmit a rotational driving force to the separation roller;

a roller shaft connecting the drive gear and the separation roller; and a bearing configured to rotatably support an opposite side of the separation roller relative to the roller shaft, wherein the holding frame has a roller receiving portion configured to receive the feed roller unit therein, wherein the feed roller unit is configured to be attached to and removed from the holding frame via the roller receiving portion on an opposite side of the holding frame relative to the recording sheet receiving portion, wherein the upper wall of the feed roller unit, which completely covers the upper portion of the pickup roller, is exposed through the upper opening opened by the top cover when the process cartridge is removed from the main body, and wherein the upper wall of the feed roller unit, which completely covers the upper portion of the pickup roller, is covered by the process cartridge when the process cartridge is attached to the main body, wherein the roller shaft protrudes by a specified distance inside the roller receiving portion, and wherein the roller receiving portion is sized to allow the feed roller unit to move the specified distance or more in the width direction inside the roller receiving portion, and wherein the bearing is configured to engage the holding frame such that the bearing moves with respect to the holding frame and movement of the bearing in the width direction is limited.

2. The image forming apparatus according to claim 1, wherein the process cartridge includes a photosensitive member.

3. The image forming apparatus according to claim 1, wherein the image forming portion includes: another process cartridge including another photosensitive member; and a belt disposed facing the process cartridge and the other process cartridge.

4. The image forming apparatus according to claim 1, wherein the recording sheet receiving portion is configured to move toward and away from the pickup roller, which is disposed upstream of the separation roller in the sheet feeding direction.

5. The image forming apparatus according to claim 1, wherein the recording sheet fed from the recording sheet receiving portion is turned in a shape of a letter U in the main body and ejected outside the main body.

6. The image forming apparatus according to claim 1, wherein the pickup roller, which is disposed upstream of the separation roller in the sheet feeding direction, is configured to pivot about the separation roller, and wherein the recording sheet receiving portion is configured to move toward and away from the pickup roller.

7. The image forming apparatus according to claim 1, wherein the feed roller unit further includes an idle gear engaging both of a gear of the pickup roller and a gear of the separation roller.

8. The image forming apparatus according to claim 1, wherein the roller receiving portion of the holding frame has a hole through which the roller shaft connects the drive gear and the separation roller.

* * * * *